US009964362B2

(12) United States Patent
Agostini

(10) Patent No.: US 9,964,362 B2
(45) Date of Patent: May 8, 2018

(54) TWISTED TUBE THERMOSYPHON

(75) Inventor: Bruno Agostini, Dietikon (CH)

(73) Assignee: ABB Research Ltd., Zurich (CH)

( * ) Notice: Subject to any disclaimer, the term of this patent is extended or adjusted under 35 U.S.C. 154(b) by 1832 days.

(21) Appl. No.: 12/768,383

(22) Filed: Apr. 27, 2010

(65) Prior Publication Data

US 2010/0270010 A1 Oct. 28, 2010

(30) Foreign Application Priority Data

Apr. 28, 2009 (EP) ..... 09158901

(51) Int. Cl.

| | |
|---|---|
| ***F28D 15/02*** | (2006.01) |
| ***F28F 1/00*** | (2006.01) |
| ***F28F 1/02*** | (2006.01) |
| *F28D 21/00* | (2006.01) |

(52) U.S. Cl.

CPC ..... *F28D 15/0233* (2013.01); *F28D 15/0266* (2013.01); *F28F 1/006* (2013.01); *F28F 1/025* (2013.01); *F28D 2021/0029* (2013.01); *F28D 2021/0031* (2013.01)

(58) Field of Classification Search

CPC ..... F28D 15/0233; F28D 15/0266; F28D 2021/0031; F28D 2021/0029; F28F 1/025; F28F 1/006

USPC ..... 165/104.21, 104.33, 175, 177, 176, 150, 165/173

See application file for complete search history.

(56) References Cited

U.S. PATENT DOCUMENTS

| | | | | |
|---|---|---|---|---|
| 3,416,600 | A * | 12/1968 | Fink | 165/175 |
| 4,001,548 | A * | 1/1977 | Bauer | 165/104.21 |
| 4,546,608 | A | 10/1985 | Shiina et al. | |
| 4,602,679 | A | 7/1986 | Edelstein et al. | |
| 4,686,961 | A | 8/1987 | Garrison | |
| 4,917,173 | A | 4/1990 | Brown et al. | |
| 4,949,164 | A | 8/1990 | Ohashi et al. | |
| 4,998,580 | A | 3/1991 | Guntly et al. | |

(Continued)

FOREIGN PATENT DOCUMENTS

| | | |
|---|---|---|
| EP | 0 245 848 A1 | 11/1987 |
| EP | 2 031 332 A1 | 3/2006 |

(Continued)

OTHER PUBLICATIONS

European Search Report dated Oct. 6, 2009.

(Continued)

*Primary Examiner* — Grant Moubry
*Assistant Examiner* — Harry Arant
(74) *Attorney, Agent, or Firm* — Taft Stettinius & Hollister LLP

(57) ABSTRACT

A thermosyphon heat exchanger includes a plurality of first conduit elements and a plurality of second conduit elements. Each first conduit element has a heat absorbing portion defining a first plane and a first fluid transfer portion defining a second plane. The first plane and the second plane are twisted relative to each other. Each second conduit element has a heat releasing portion and a second fluid transfer portion or a connection to a fluid return line. At least one first conduit element and at least one second conduit element are connected to each other such that the fluid in the thermosyphon heat exchanger can flow in a closed loop through said first conduit element and said second conduit element.

21 Claims, 2 Drawing Sheets

(56) References Cited

U.S. PATENT DOCUMENTS

| | | | | |
|---|---|---|---|---|
| 5,033,539 | A | 7/1991 | Kohtaka | |
| 5,099,576 | A | 3/1992 | Shinmura | |
| 5,205,353 | A | 4/1993 | Willemsen et al. | |
| 5,267,611 | A | 12/1993 | Rosenfeld | |
| 5,303,770 | A | 4/1994 | Dierbeck | |
| 5,329,996 | A | 7/1994 | Rosenfeld | |
| 5,379,830 | A | 1/1995 | Itoh | |
| 5,469,915 | A | 11/1995 | Cesaroni | |
| 5,538,079 | A | 7/1996 | Pawlick | |
| 5,638,900 | A | 6/1997 | Lowenstein et al. | |
| 5,692,558 | A | 12/1997 | Hamilton et al. | |
| 5,695,007 | A | 12/1997 | Fauconnier et al. | |
| 5,713,413 | A | 2/1998 | Osakabe et al. | |
| 5,729,995 | A | 3/1998 | Tajima | |
| 5,790,376 | A | 8/1998 | Moore | |
| 5,899,265 | A | 5/1999 | Schneider et al. | |
| 5,901,037 | A | 5/1999 | Hamilton et al. | |
| 5,924,481 | A | 7/1999 | Tajima | |
| 5,940,270 | A | 8/1999 | Puckett | |
| 6,005,772 | A | 12/1999 | Terao et al. | |
| 6,084,771 | A | 7/2000 | Ranchy et al. | |
| 6,119,767 | A | 9/2000 | Kadota et al. | |
| 6,341,645 | B1 | 1/2002 | Tanaka et al. | |
| 6,357,517 | B1 | 3/2002 | Osakabe et al. | |
| 6,405,792 | B1 | 6/2002 | Rosenfeld et al. | |
| 6,523,606 | B1 * | 2/2003 | Dienhart et al. | 165/144 |
| 6,546,999 | B1 * | 4/2003 | Dienhart et al. | 165/150 |
| 6,668,910 | B2 | 12/2003 | Gawve | |
| 6,687,122 | B2 | 2/2004 | Mongarad | |
| 6,705,390 | B2 | 3/2004 | Ohara | |
| 6,804,117 | B2 | 10/2004 | Phillips et al. | |
| 6,809,424 | B2 | 10/2004 | Pike et al. | |
| 6,840,308 | B2 | 1/2005 | Ritter et al. | |
| 6,840,311 | B2 | 1/2005 | Ghosh et al. | |
| 6,874,567 | B2 | 4/2005 | Ohara | |
| 6,898,082 | B2 | 5/2005 | Dessiatoun et al. | |
| 6,938,685 | B2 | 9/2005 | Duerr et al. | |
| 6,988,541 | B2 | 1/2006 | Nakajima et al. | |
| 6,993,838 | B1 * | 2/2006 | Staffa et al. | 29/890.052 |
| 7,007,746 | B2 | 3/2006 | Wu et al. | |
| 7,017,655 | B2 | 3/2006 | Wilson et al. | |
| 7,017,657 | B2 | 3/2006 | Sugito et al. | |
| 7,077,189 | B1 | 7/2006 | Reyzin et al. | |
| 7,234,511 | B1 | 6/2007 | Lesage | |
| 7,262,966 | B2 | 8/2007 | Liao | |
| 7,290,597 | B2 * | 11/2007 | Takano | 165/173 |
| 7,435,623 | B2 | 10/2008 | Chrysler et al. | |
| 7,549,465 | B2 | 6/2009 | Gong et al. | |
| 7,571,618 | B2 | 8/2009 | Dessiatoun | |
| 7,665,511 | B2 | 2/2010 | Bhatti et al. | |
| 7,770,632 | B2 | 8/2010 | Bhatti et al. | |
| 7,819,174 | B2 | 10/2010 | Huang et al. | |
| 7,958,934 | B2 | 6/2011 | Nara et al. | |
| 2001/0004935 | A1 | 6/2001 | Sanada et al. | |
| 2001/0006101 | A1 | 7/2001 | Chu et al. | |
| 2002/0014324 | A1 | 2/2002 | Dipaolo | |
| 2002/0179284 | A1 | 12/2002 | Joshi et al. | |
| 2003/0010477 | A1 | 1/2003 | Khrustalev et al. | |
| 2003/0079864 | A1 | 5/2003 | Ohara | |
| 2003/0121649 | A1 | 7/2003 | Seiler et al. | |
| 2003/0147214 | A1 | 8/2003 | Patel et al. | |
| 2003/0192677 | A1 | 10/2003 | Rong | |
| 2004/0069459 | A1 | 4/2004 | Tonosaki et al. | |
| 2004/0099407 | A1 | 5/2004 | Parish, IV et al. | |
| 2004/0104020 | A1 | 6/2004 | Haller et al. | |
| 2004/0134641 | A1 | 7/2004 | Tanaka | |
| 2004/0163798 | A1 | 8/2004 | Ghosh et al. | |
| 2004/0179338 | A1 | 9/2004 | Belady et al. | |
| 2005/0006061 | A1 | 1/2005 | Quisenberry et al. | |
| 2005/0024831 | A1 | 2/2005 | Phillips et al. | |
| 2005/0039887 | A1 | 2/2005 | Parish, IV et al. | |
| 2005/0056403 | A1 | 3/2005 | Norlin et al. | |
| 2005/0194124 | A1 | 9/2005 | Geiger et al. | |
| 2005/0217829 | A1 | 10/2005 | Belits et al. | |
| 2005/0286230 | A1 | 12/2005 | Yatskov | |
| 2006/0000582 | A1 | 1/2006 | Phillips et al. | |
| 2006/0060327 | A1 | 3/2006 | Yu et al. | |
| 2006/0254753 | A1 | 11/2006 | Phillips et al. | |
| 2007/0133175 | A1 | 6/2007 | Wu | |
| 2007/0242438 | A1 | 10/2007 | Belits et al. | |
| 2007/0246206 | A1 | 10/2007 | Gong et al. | |
| 2007/0251671 | A1 | 11/2007 | Barnes et al. | |
| 2007/0284093 | A1 | 12/2007 | Bhatti et al. | |
| 2007/0295488 | A1 | 12/2007 | Fielding et al. | |
| 2008/0266884 | A1 | 10/2008 | Bogner et al. | |
| 2009/0056916 | A1 * | 3/2009 | Yesin et al. | 165/104.21 |
| 2009/0101308 | A1 | 4/2009 | Hardesty | |
| 2009/0107663 | A1 | 4/2009 | Weber et al. | |
| 2009/0166022 | A1 | 7/2009 | Desai et al. | |
| 2009/0228150 | A1 | 9/2009 | Alston | |
| 2009/0229794 | A1 | 9/2009 | Schon | |
| 2009/0308571 | A1 | 12/2009 | Thompson et al. | |
| 2009/0308583 | A1 | 12/2009 | Dees et al. | |
| 2010/0108303 | A1 | 5/2010 | Sundralingam et al. | |
| 2010/0175862 | A1 | 7/2010 | Franklin et al. | |
| 2010/0218511 | A1 | 9/2010 | Rockenfeller | |

FOREIGN PATENT DOCUMENTS

| | | | | |
|---|---|---|---|---|
| JP | 59018387 | A | * | 1/1984 |
| JP | 07198279 | A | * | 8/1995 |
| JP | 09167818 | A | * | 6/1997 |
| JP | 10-335550 | A | | 12/1998 |
| JP | 2001-227886 | A | | 8/2001 |
| JP | 2003-130561 | A | | 5/2003 |

OTHER PUBLICATIONS

Office Action issued by the U.S. Patent and Trademark Office in the U.S. Appl. No. 12/768,339, dated Dec. 28, 2012, U.S. Patent and Trademark Office, Alexandria, VA. (18 pages).

Office Action dated Mar. 29, 2012, issued by the U.S. Patent and Trademark Office in corresponding U.S. Appl. No. 12/768,339. (17 pages).

Office Action dated Jul. 20, 2012, issued by the U.S. Patent and Trademark Office in corresponding U.S. Appl. No. 12/768,339. (14 pages).

Office Action dated Jun. 4, 2013, issued by the U.S. Patent and Trademark Office in corresponding U.S. Appl. No. 12/768,339. (23 pages).

Office Action dated Jul. 29, 2014, issued by the U.S. Patent and Trademark Office in corresponding U.S. Appl. No. 12/768,339. (19 pages).

* cited by examiner

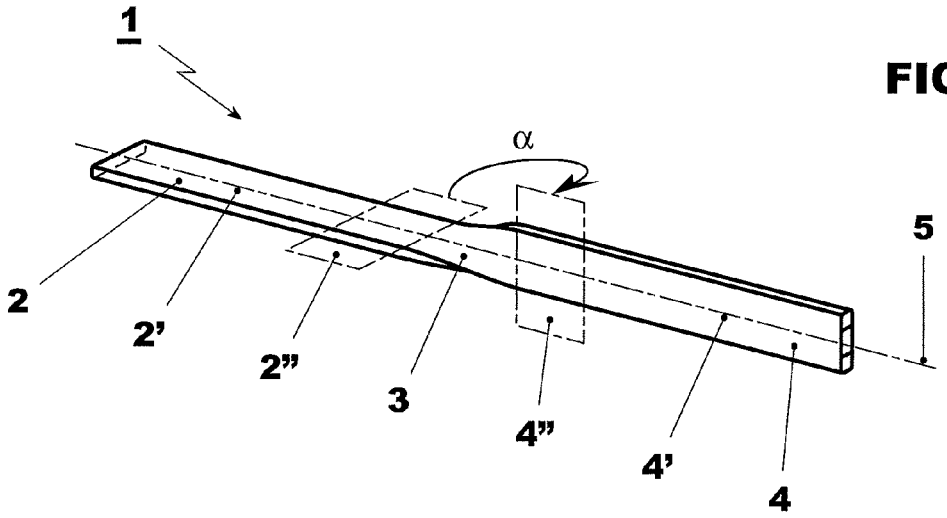
FIG. 1
FIG. 2
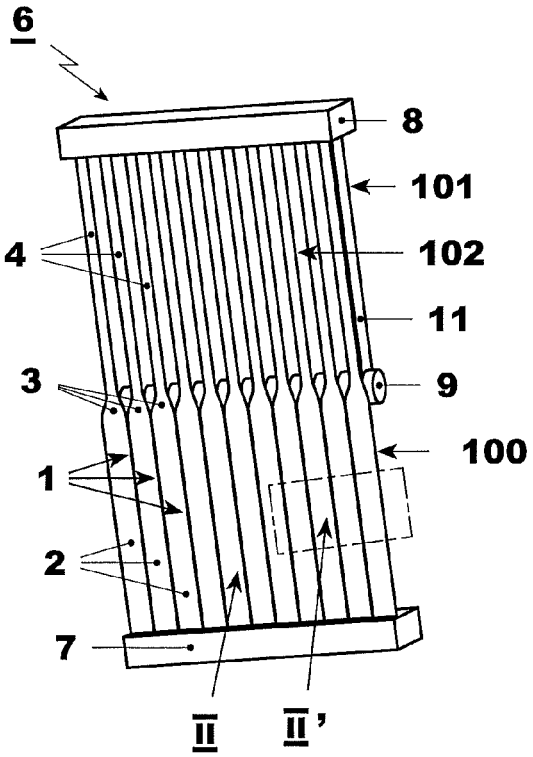
FIG. 3
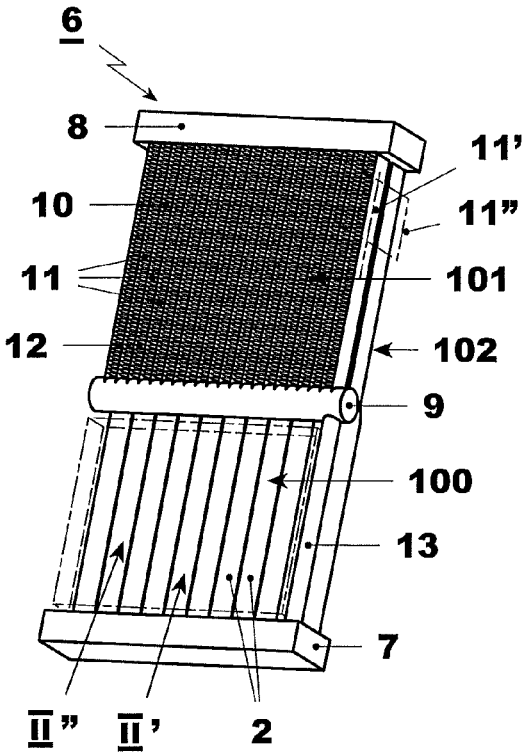

TWISTED TUBE THERMOSYPHON

RELATED APPLICATIONS

This application claims priority under 35 U.S.C. § 119 to European Patent Application No. 09158901.0 filed in Europe on Apr. 28, 2009, the entire content of which is hereby incorporated by reference in its entirety.

FIELD

The disclosure relates to a thermosyphon heat exchanger and to an electric and/or electronic device including such a thermosyphon heat exchanger.

BACKGROUND INFORMATION

In U.S. Pat. No. 6,840,311 B2, a thermosyphon assembly is shown. The thermosyphon assembly is used for dissipating heat generated by electronic components. The assembly uses a working fluid and includes a tube having a first end and a second end and a flat cross section defining an elongated chamber. The tube has an evaporation region for receiving heat to evaporate the working fluid into a vaporized working fluid within the chamber. The chamber can be disposed between a first condensation region and a second condensation region opposite to the first condensation region. The vaporized working fluid can be condensed back into a liquefied working fluid within the chamber. Each of the condensation regions has a first portion extending upwardly at a first angle from the evaporation region and a second portion extending upwardly at a second angle different than the first angle.

Placing a plurality of such thermosyphon assemblies as close as possible next to each other in order to form a connected heat absorbing region can lead to an enlarged heat dissipating region formed by the plurality of condensation regions. An effective cooling of the heat dissipating region that is formed can be hindered, because any external cooling fluid flow used to cool a surface of the heat dissipating region would have to flow long distances (for example, an entire length of the assembly or a multitude of breadths thereof) on hot surfaces thereby correspondingly heating up and losing cooling capacity. Whole regions to be cooled may not be cooled properly.

SUMMARY

An exemplary thermosyphon heat exchanger includes a plurality of first conduit elements and a plurality of second conduit elements. At least one first conduit element includes a heat absorbing portion extending in a first plane and a first fluid transfer portion extending in a second plane. The first plane and the second plane are twisted relative to each other about an angle of a twisting axis. Each second conduit element has a heat releasing portion that is fluidly connected to a second fluid transfer portion and/or a connection to a fluid return line. At least one first conduit element and at least one second conduit element are fluidly connected to each other for fluid to flow in a closed loop through the at least one conduit element and the at least one second conduit element.

BRIEF DESCRIPTION OF THE DRAWINGS

Exemplary embodiments of the disclosure are now described by way of example and with reference to the accompanying drawings in which like numerals are used to indicate like parts and in which:

FIG. 1 shows a single twisted multi-port extrusion tube as a conduit element;

FIG. 2 shows a first perspective of a first exemplary embodiment of a thermosyphon heat exchanger;

FIG. 3 shows a second perspective of the first exemplary embodiment of the thermosyphon heat exchanger;

DETAILED DESCRIPTION

Figure 4:
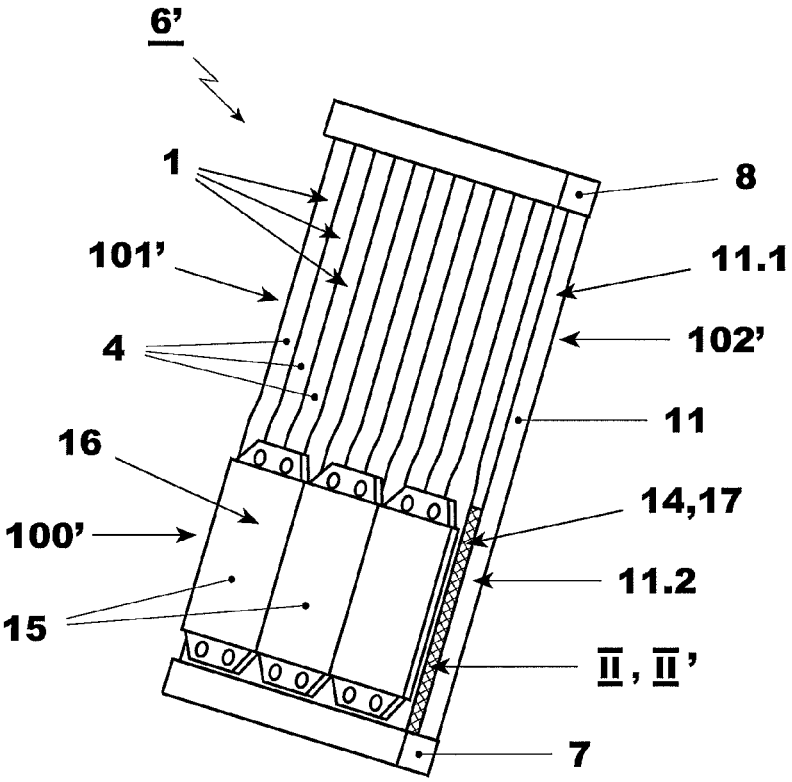
FIG. 4 shows a first perspective of a second exemplary embodiment of a thermosyphon heat exchanger.

Exemplary thermosyphon heat exchangers that can allow effective cooling of extensive heat releasing surfaces as well as an exemplary electric and/or electronic devices including such thermosyphon heat exchangers are disclosed.

An exemplary embodiment of a thermosyphon heat exchanger includes a plurality of first conduit elements and a plurality of second conduit elements. The conduit elements can respectively conduct heat and an internal cooling fluid, which may evaporate within the conduit elements in a heat absorbing process and condensate within the conduit elements in a heat releasing process. The conduit elements may be of different types, shapes and materials. A cross section of the conduit elements may be point-symmetric. Non-point-symmetric cross sections may also be used. In particular, rectangular conduit elements with one or more conduit channels may be used (multi-port extrusion tubes, also called MPE-Tubes). At least one first conduit element can include a heat absorbing portion extending in a first plane and a first fluid transfer portion extending in a second plane. The planes can be defined by the largest extension of the cross section. The planes of the heat absorbing portions may be parallel to a heat releasing plane of a heat source to be cooled. The first plane and the second plane can be twisted in relation to each other about an angle of a twisting axis. The twisting axis can be defined by at least one of the first conduit element and the second conduit element as well as by longitudinally extending portions of the first and/or second conduit element. Thus, relative orientations between the planes can allow a more efficient cooling. In this manner, every plane can be provided with fresh cooling air. Further, each second conduit element can have a heat releasing portion and a second fluid transfer portion or a connection to a fluid return line. An exemplary thermosyphon heat exchanger can include a first conduit element and a second conduit element that are fluidly connected to each other such that the fluid in the thermosyphon heat exchanger can flow in a closed loop. This way, in particular in combination with the more efficient, i.e., thermally effective cooling, only a small amount of fluid is needed within the thermosyphon.

Keeping a twisted portion, where the actual change of orientation about a twisting angle of a twisting axis is performed, comparatively short compared to a total length of at least one of the first conduit elements and the second conduit elements can contribute to an improvement of technically useable surface of the at least one first conduit element. Specifically the shorter the length of the twisted portion, the more the length of the heat absorbing portion of the at least one first conduit element and the first fluid transfer portion can remain. Depending on the exemplary embodiment of the thermosyphon and/or the size and shape of the profiles from the conduit elements as well as on their bending properties, the twisted portion of at least one first conduit element of a plurality of first conduit elements can extend over a length of about 5 to about 30 percent of the total length, preferably over a length of about 8 to about 20 percent of the total length, e.g., about 10 percent of the total length, or as short as possible. If the twisting length can be as short as possible, e.g., about five times the width of the conduit element, the twisting length can be defined by profile factors such as material properties (Young's modulus) as well as a size and shape of the profile of the conduit element to be twisted such that any detrimental properties of the conduit element may be avoided and a reliable function provided.

Moreover the twisting can satisfy both needs in term of an optimal installability of at least one heat emitting electric and/or electronic power component on a dedicated mounting area at the heat absorbing region as well as in terms of cooling of the condenser section by an external cooling means, e.g., a fan. Thus, it can become possible to create an optimized accessibility to a mounting area for the electric and/or electronic power component which is often oriented differently than a fluidic optimal orientation of the mounting area and/or the heat releasing region formed by the second conduit elements. Depending on the exemplary embodiment of the thermosyphon heat exchanger and/or the profiles and size of the first conduit elements, the electric and/or electronic power component can be thermally connectable directly to the former by fastening, e.g., with bolts driven in tapped holes provided in the first conduit elements in the first plane at the mounting area. An intermediate plate can be thermally connectable to both the electric and/or electronic power component and the first conduit elements, if necessary. In one exemplary embodiment of the electric and/or electronic device, the at least one electric and/or electronic power component can be thermally connected to the first conduit element or elements by fastening the at least one electric and/or electronic power component to the intermediate plate such that the first conduit element or elements can be clamped therebetween.

Depending on the requirements of the installability of the at least one electric and/or electronic power component to the first conduit or the first conduits at the mounting area, at least one first conduit element of the plurality of first conduit elements can be twisted whereas the remaining first elements of the plurality of first conduit elements may have another shape, e.g., are untwisted (i.e., straight).

In addition, the twisting forms a comparatively simple and thus economic operation compared to known approaches where two conduits with different planar orientation would have been soldered to an intermediate channel instead in order to achieve a different alignment of the mounting area to the planar orientation of the heat releasing region. Furthermore, the cross-section of the interior of the conduits, e.g., at least two channels in an MPE tube, remain functionally unaffected to a large extent, e.g., in that a flow resistance can be maintained throughout the conduit.

When the condensator section with the second conduit elements is cooled by a forced air flow provided by a fan, for example, it can be advantageous to arrange the airflow on the condenser side of the thermosyphon heat exchanger device for at least two reasons. First, the air flow can be cooler and thus thermally more effective/efficient, if it hits the condenser conduits, i.e., the second conduit elements, prior to coming in contact with the first conduit elements located above the evaporation portion, i.e., above the heat absorbing plate at the mounting area. Second, an undesired pre-condensation of the vapour in the evaporator conduit section located above the evaporation portion, i.e., the first fluid transfer portion, can be kept low. This is because the difference in temperature between the refrigerant-rich vapour and the interior walls of the condenser conduits can be smaller as the air can be pre-heated by the condenser conduits arranged upstream of the evaporator conduits. Alternatively and/or in addition, the most effective condenser section of the second conduit elements can be located above the most effective evaporator section of the first conduit elements when seen in the longitudinal axis, presuming a cooling flow, e.g., from a fan, is hitting the second conduit elements first prior to contacting the first conduit elements. Specifically, the most effective condenser section and the most effective evaporator section can be displaced against one another in the direction of the longitudinal axis, e.g, the first longitudinal axis or the second longitudinal axis. The displacement can be defined such that the most effective condenser section and the most effective evaporator section do at least mainly not overlap when seen from a direction of the cooling flow. Specifically, the first fluid transfer portion overlaps mainly with the most effective evaporator section, i.e., at least a main portion of the heat releasing portion. The exemplary thermosyphon heat exchanger can be dimensioned such that a length of the first fluid transfer portion is minimal in order to prevent or at least to hamper an excessive condensation of the refrigerant vapour already in the first conduit elements. However, the length of the first fluid transfer portion can be balanced against a length of the most effective condenser section such that a condensation rate in the first fluid transfer portion can be as low as possible without unduly jeopardizing a fair condensation rate in the condenser conduits, i.e., the second conduit elements in the most effective condenser section.

As an option, the first fluid transfer portion may be shielded at least partly against the air flow by sheet-like flow protectors arranged inbetween the first and second conduit elements and extending in the longitudinal direction. Depending on the embodiment, these flow protectors may feature a crescent cross-section with reference to their longitudinal axis. Alternatively thereto, the first fluid transfer portion can be thermally isolated to the ambient, e.g., a forced air flow, by a suitable coating, e.g., a paint or laquer.

In a further exemplary embodiment, the heat absorbing portion can define a first longitudinal axis included in the first plane while the first fluid transfer portion can define a second longitudinal axis included in the second plane. The first longitudinal axis and the second longitudinal axis can extend parallel to each other. The first plane and the second plane can be respectively defined by the largest extension of the cross section and the first or second longitudinal axis respectively. The largest extension of the cross section can preferably be arranged parallel to a heat source to be cooled by the thermosyphon. In other exemplary embodiments, however, the axes can form an angle instead of being parallel to each other.

In a further exemplary embodiment, at least two first planes of the plurality of conduit elements can be plane-parallel to one another. An efficient absorption of heat from a heat source to be cooled by the thermosyphon can result.

An exemplary embodiment of a thermosyphon heat exchanger can include a plurality of first conduit elements. Each first conduit element can have a specific heat absorbing portion defining a specific first plane and a specific first longitudinal axis included therein and a specific first fluid transfer portion defining a specific second plane and a specific second longitudinal axis included therein. In each case, the specific first longitudinal axis and the specific second longitudinal axis can be parallel to each other. The specific first plane and the specific second plane can be twisted relative to each other with respect to their axis; i.e., they form an angle to each other. Further, at least two specific first planes of the plurality of conduit elements can be plane-parallel to one another. This way, plane-parallel first planes can form one or many cohesive heat absorbing regions.

The specific second planes corresponding to the specific first planes can each be twisted such that an effective cooling of any of the specific second planes can be possible. For example, the specific second planes can be twisted into a position perpendicular to the plane-parallel specific first planes. An external cooling fluid flow, e.g., an airflow, parallel to the specific second planes does, independently of the number of conduit elements used, only have to pass a single breadth of a conduit element. No serious loss of cooling capacity occurs. Thus cooling can be efficient.

In contrast thereto, in U.S. Pat. No. 6,840,311 B2, the different portions and the evaporation region each define a specific plane and a specific longitudinal axis included therein but no two of the specific planes form an angle relative to each other with respect to any of the specific longitudinal axes. The regions are thus not twisted relative to each other. The above described effect of external cooling fluid flow having only a width of a conduit element to pass—independently of the number of conduit elements used—is not achievable.

In a further exemplary embodiment at least one first conduit element and/or at least one second conduit element can include at least two heat and fluid conducting channels. The fluid conducted may be liquid or vaporous. This way, a bigger heat exchanging surface between the fluid to be cooled and the respective conduit element can be realised. Cooling can thus be more efficient. Moreover, the first plane can include a mounting area designed to receive at least one electric and/or electronic power component or a portion thereof in case that the at least one electric and/or electronic power component expands across more than one first conduit element.

In an exemplary embodiment, the first and second longitudinal axes can extend parallel to each other and/or form a common axis. The common axis improves the manufacturing process. The parallelism allows advantageous geometric variations adapted to specific needs.

In a further exemplary embodiment, at least two second planes can extend parallel to each other and/or at least one second plane can be aligned transversely, in particular perpendicularly, to the least one first plane forming a mounting area. With at least two second planes parallel to each other, a bar grate structure can be formed for enlarging the surface for heat transfer. Thus, efficient cooling can be simplified. With at least one second plane perpendicular to at least one first plane the at least one second plane can be efficiently cooled by external cooling fluid flow and efficient cooling can be simplified. With a plurality of second planes perpendicular to at least one first plane, efficient cooling by external cooling fluid flow can be further simplified.

In a further exemplary embodiment at least one first conduit element of the plurality of first conduit elements can be a twisted multi-port extrusion tube. Due to the structure of a multi-port extrusion tube efficient cooling can be further simplified.

In a further exemplary embodiment, at least one cooling element can be arranged between two first fluid transfer portions, in particular between two neighbouring second conduit elements. Through an addition of an appropriate cooling element between two first fluid transfer portions, the cooling surface can be increased without having the external cooling fluid flow to pass more than a width of a conduit element and efficient cooling can be further simplified.

In a further exemplary embodiment, at least one first conduit element can be connected to a first and/or a second manifold. This way, internal cooling fluid can be collected from and/or supplied to the at least one conduit element. A plurality of conduit elements connected to the first and/or second manifold can exchange internal cooling fluid with the first and/or second manifold and/or with each other. Depending on the embodiment, the first manifold can be arranged between the plurality of second conduit elements and the plurality of heat absorbing portions. In particular, arranged below the plurality of heat absorbing portions. The second manifold can be arranged between the plurality of first fluid transfer portions and the plurality of second conduit elements. In particular, arranged above the plurality of second conduit elements.

In a further exemplary embodiment, the first manifold and the second manifold can be fluidly connected by at least one second conduit element extending in a third plane and a third longitudinal axis included therein. This second conduit element defines a third plane and can extend in the direction of a third longitudinal axis included therein and can be arranged with the third axis extending parallel to the first and second axis of a first conduit element; e.g., aside, before, behind, above or beneath. The second conduit element can exchange internal cooling fluid with the first and/or second manifold and/or with a first conduit element and/or with an additional second conduit element.

In a further exemplary embodiment, at least one further cooling element can be arranged between two second conduit elements. Through the addition of an appropriate cooling element between two directly neighbouring second conduit elements the cooling surface can be increased and efficient cooling can be further simplified.

In a further exemplary embodiment, at least two third planes are extending parallel to each other and/or at least one third plane can extending transversely, in particular perpendicularly, to the at least one first plane. With at least two third planes parallel to each other, a further bar grate cooling structure can be formed for simplifying efficient cooling In particular, when the further bar grate cooling structure is arranged behind a first conduit element. With at least one third plane perpendicular to at least one first plane it is possible, that the at least one third plane can efficiently be cooled by external cooling fluid flow. In particular, when the at least one third plane is arranged behind or parallel to a first conduit element. With a plurality of third planes perpendicular to at least one first plane efficient cooling by external cooling fluid flow can be further simplified, even when the plurality of third planes is arranged behind a first conduit element.

In a further exemplary embodiment, at least one third plane can be arranged plane-parallel with the at least one second plane. This way, an external cooling fluid flow can pass both the second plane and the third plane successively. Although a warming up of the cooling fluid may occur while passing the first conduit element before passing the second conduit element, the cooling fluid is not dramatically warmed up before passing the second conduit element, only one width of a first conduit element as a heat releaser is passed before arriving at the second conduit element.

According to a further exemplary embodiment, a third manifold can be fluidly connected to the heat releasing portions of at least one second conduit element and to the first manifold. It can be advantageous to establish the connection between the third manifold and the first manifold by a common return line. Thus, the vapour being returned to liquid while cooling within the heat releasing portions of the second conduit elements can be gathered in a common third manifold and transferred via a common return line to the first manifold. From there it is supplied to the heat absorbing portions of the first conduit elements. The third manifold may be connected to the first manifold via at least one second fluid transfer line that may be formed in one piece with the heat releasing portions of the second conduit element.

The provision of the third manifold can allow an increase in the degree of design freedom in that a condenser section formed by the first conduit elements and an evaporator section formed by the second conduit elements may include a different number of conduits. Thus, a separate optimization of the condenser section and the evaporator section can be achievable. For example the first conduit elements can be arranged relative to the second conduit elements in a displaced, i.e., staggered manner to increase a flow resistance of the air flow. However, care has to be taken to keep the pre-condensation rate in the first conduit elements within sensible boundaries in view of thermal efficiency. In addition, such an embodiment allows arranging the at least one heat emitting electric and/or electronic power component on an opposite side of the at least one thermosyphon heat exchanger such that they are visible from the condenser portion, instead. An advantage in such an embodiment resides in an optimized, i.e., very small thickness. In case that the heat emitting electric and/or electronic power component measures less than the condenser portion with the second conduit elements in thickness, when seen in the direction of the ambient flow, providing an embodiment of a thermosyphon heat exchanger device having a thickness of merely the heat absorbing and heat releasing portion can be achievable. Depending on the embodiment, the heat emitting electric and/or electronic power components can be provided and thermally connected on both sides of the heat releasing portion.

An exemplary electric and/or electronic device including at least one heat emitting electric and/or electronic power component that can be thermally connected to at least one thermosyphon heat exchanger. The heat emitting electric and/or electronic power component can be formed, e.g., by semiconductor components, resistors, printed circuitry and the like.

An exemplary embodiment of the thermosyphon heat exchanger and the electric and/or electronic device described above can be gravity-type thermosyphons. However, they are not limited to a strictly perpendicular alignment of the first and second conduit elements. Their alignment is subject to variations, e.g., if their orientation is changed by rotating them about a virtual transversal axis defined by the shape of a first, second and/or third manifold, as long as their function remains untouched and as long as the evaporating section of the first conduit elements is not running dry.

FIG. 1 shows a perspective view of a twisted multi-port extrusion tube as first conduit element 1. The conduit element 1 has a heat absorbing portion 2 defining a first plane 2" that can be arranged in parallel to the heat source and a first longitudinal axis 2' included therein. The fluid in the heat absorbing portion 2 can be liquid originating from a first manifold 7. The first conduit element 1 also has a first fluid transfer portion 4 defining a second plane 4" and a second longitudinal axis 4' included therein. The fluid in the first fluid transfer portion 4 is vapour originating from the intermediate portion 3 and ascending to a second manifold 8. The heat absorbing portion 2 and the first fluid transfer portion 4 can be connected by an intermediate portion 3. The fluid in the intermediate portion 3 contains vapour originating from the heat absorbing portion 2 and ascending to the first fluid transfer portion 4. The first longitudinal axis 2' and the second longitudinal axis 4' form a common axis 5. The first plane 2" and the second plane 4" are twisted relative to each other with respect to the common axis 5. Both planes 2" and 4" form an angle $\alpha$ with respect to the common axis. $\alpha$ is preferably 90°.

The width, thickness, length and the shape of the first conduit elements 1, the heat absorbing portions 2, the intermediate portions 3 and the first fluid transfer portions 4 can each be adapted to specific needs. The heat absorbing surface to heat releasing surface ratio, for example, can be variable and adaptable to specific constructive constraints. The angles $\alpha$ can also each be adapted to specific needs and constraints. For example, a cooling airflow can be introduced inclined to the first plane. Structures within and/or on the outside surface of the conduit elements can also be formed and structured in a suitable way. For example, to allow better heat absorbance and/or heat release and/or contact with a heat source as the case may be.

FIG. 2 shows a front perspective of a first exemplary embodiment of the thermosyphon heat exchanger 6. In the first exemplary embodiment of the thermosyphon heat exchanger 6, all first conduit elements 1 are twisted about an angle alpha of a twisting axis defined by the longitudinal shape of the first conduit elements 1. The twisting axis of each first conduit elements 1 corresponds essentially to the center line, i.e., the neutral axis of the profile forming the first conduit elements 1. Side by side, a plurality of first conduit elements 1 can be arranged in succession, thereby forming a row of first conduit elements 1. The corresponding absorbing portions 2 and their respective first planes 2" can be plane-parallel to one another. The plane-parallel heat absorbing portions 2 and their respective first planes 2" form a common heat absorbing surface II defining a common plane II'. The first fluid transfer portions 4 and their corresponding second planes 4" can be arranged in parallel to each other and perpendicular to their respective first planes 2" and the common plane II'. Between every two directly neighbouring second conduit elements 11 one cooling element 10 can be arranged (see FIG. 3).

The first conduit elements 1 can be connected to a first manifold 7 at a first end and to a second manifold 8 at a second end. The first manifold 7 allows supply of a coolant to the first conduit elements 1. The second manifold 8 allows collection of internal cooling fluid and/or the vapour thereof from the first conduit elements 1.

A second conduit element 11 connects the second manifold 8 to a third manifold 9. The fluid in the second conduit element 11 is vapour originating from the second manifold 8 and descending to a third manifold 9 while being cooled down and becoming a liquid again. The fluid in the third manifold 9 can therefore be liquid originating from the second conduit element 11 and descending to the cooling fluid return line 13. The third manifold 9 and the first manifold 7 can be connected via a cooling fluid return line 13 shown in FIG. 3. The fluid in the cooling fluid return line 13 can be liquid originating from the third manifold 9 and descending to the first manifold 7. A closed loop for the fluid thus can be realised. The second manifold 8 allows supply of the second conduit element 11 with internal cooling fluid being heated from a device to be cooled. The third manifold 9 allows collection of internal cooling fluid after condensation from the second conduit element 11. The first conduit elements 1 include first fluid conducting channels having channel walls and the second conduit elements 11 include second fluid conducting channels having channel walls. The first fluid conducting channels and the second fluid conducting channels have no common channel wall.

The thermosyphon heat exchanger 6 has a heat absorbing region 100, a heat releasing region 101 and a fluid transfer region 102.

The heat absorbing region 100, the heat releasing region 101 and the fluid transfer region 102 serve as evaporator, condenser region and fluid connection for supplying vapour to the condenser region for the internal cooling fluid respectively.

FIG. 3 shows a rear perspective of the first exemplary embodiment of the thermosyphon heat exchanger 6 according to the disclosure in a second perspective. Like numerals are used to indicate like parts. The third manifold 9 and the first manifold 7 are connected via the cooling fluid return line 13. Circular flow of internal cooling fluid can thus be possible.

The first manifold 7, the third manifold 9 and the common plane II' define a support area in which a heat source (not shown) can be placed. The heat source, e.g., a power semiconductor device, can be thermally connectable to the first conduit elements of the heat absorbing region 100 such that it transfers heat to the heat absorbing portions 2 of the first conduit elements 1. In this exemplary embodiment, the at least one heat emitting electric and/or electronic power component can be attached from the condenser side, i.e., from the heat releasing side. The liquid internal cooling fluid within the heat absorbing portions 2 heats up, evaporates and moves to the second manifold 8 via the first fluid transfer portions 4. The second manifold 8 can be supplied with evaporated internal cooling fluid by the first conduit elements 1 which in turn are supplied with liquid internal cooling fluid by the first manifold 7. Via the second conduit elements 11, evaporated internal cooling fluid from the second manifold 8 further cools down and condenses finally. The liquid can be fed to the third manifold 9. The third manifold 9 in turn feeds the first manifold 7 with the condensed liquid internal cooling fluid via the cooling fluid return line 13 where the liquid internal cooling fluid further cools down. Thus, an internal cooling fluid circuit can be formed by the first manifold 7, the plurality of conduit elements 1, the second manifold 8, the plurality of second conduit elements 11, the third manifold 9 and the cooling fluid return line 13.

Between every two directly neighbouring second conduit elements 11 can be arranged a cooling element 10 or further cooling element 12.

Each second conduit element 11 defines a specific third plane 11" and a specific third longitudinal axis 11' included therein. Each heat absorbing portion 2 of a first conduit element 1 defines a specific first plane 2" and a specific first longitudinal axis 2' included therein. Each first fluid transfer portion 4 of a first conduit element 1 defines a specific second plane 4" and a specific longitudinal axis 4' included therein. In FIG. 3, the first longitudinal axis 2' and the second longitudinal axis 4' of any first conduit element 1 can be parallel to each other. The third longitudinal axes 11' of the second conduit elements 11 can also be parallel to first longitudinal axes 2' and the second longitudinal axes 4' of the first conduit elements 1. The first planes 2" are plane-parallel to one another. The second planes 4" are parallel to each other. The third planes 11" are also parallel to each other. In the shown exemplary embodiment, each second plane 4" has a third plane 11" that is oriented plane-parallel to it. In other exemplary embodiments it is only required that at least one second plane 4" is parallel to at least one third plane 11". Turbulences and resistances in the cooling air flow can thus be minimized.

In FIG. 3, the third plane 11" is perpendicular to a first plane (2"). The third plane 11" can be plane-parallel to the second plane 4" of a first conduit element. In particular, it can be advantageous to stack the second conduit elements 11 and the first fluid transfer portion 4 of the first conduit elements 1. The cross section hindering a cooling airflow can then be minimized then. In this exemplary embodiment, a plurality of third planes 11", respectively plane-parallel to a second plane 4" of a first conduit element 4, are arranged in parallel.

FIG. 4 shows a first perspective of a second exemplary embodiment of the thermosyphon heat exchanger 6' according to the disclosure. Like numerals are used to indicate like parts. In contrast to the first exemplary embodiment, the second exemplary embodiment of the thermosyphon heat exchanger 6' does not have three manifolds 7, 8, 9 but only the first manifold 7 and the second manifold 8. The first manifold 7 and the second manifold 8 are connected by the first conduit elements 1 and the elongated second conduit elements 11. Each elongated second conduit element 11 has a heat releasing portion 11.1 and a second fluid transfer portion 11.2. The second fluid transfer portion 11.2 functions as substitute for the third manifold 9 or at least the cooling fluid return line 13. Alternatively, any second fluid transfer portion 11.2 can be replaced by a third manifold 9 connected to one or more heat releasing portions 11.1 of one or more second conduit elements 11 and connected to the first manifold 7 via a cooling fluid return line 13. FIG. 1 and FIG. 2 show an example for such a replacement. The fluid in the heat releasing portion 11.1 is vaporous. The fluid in the heat releasing portion 11.1 is vapour originating from the second manifold 8 and descending to the second fluid transfer portion 11.2. The fluid in the second fluid transfer portion 11.2 is liquid originating from the heat releasing portion 11.1 and descending to the first manifold 7. A closed loop for the fluid can thus be realised. A cooling element 10 can be arranged between every two directly neighbouring second conduit elements 11 as it is common practice for example in water cooled combustion engines of vehicles.

The plurality of first conduit elements 1 can be arranged in succession side by side. The corresponding heat absorbing portions 2 and their respective first planes 2" can again be plane-parallel to one another thereby forming the common heat absorbing surface II defining the common plane II'. As in FIG. 2 and FIG. 3, the first fluid transfer portions 4 and their corresponding second planes 4" are arranged in parallel to each other and perpendicular to their respective first planes 2" and the common plane II'. A cooling element 10 can again be arranged between every two directly neighbouring second conduit elements 11.

The first conduit elements 1 can be connected to the first and to the second manifold 7, 8. The first manifold 7 allows supply with internal cooling fluid to the first conduit elements 1 while the second manifold 8 allows collection of internal cooling fluid from the conduit elements 1.

The second conduit elements 11 connect the second manifold 8 to the first manifold 7. The internal cooling fluid collected by the second manifold 8 can then be supplied to the first manifold 7 via the second conduit elements 11. Circular flow of internal cooling fluid can thus be possible.

The heat sources 15 feed the heat absorbing portions 2 of the first conduit elements 1 with heat. As in FIG. 2 and FIG.

3 the liquid internal cooling fluid within the heat absorbing portions 2 heats up, evaporates and moves to the second manifold 8 via the first fluid transfer portions 4. The evaporated internal cooling fluid starts cooling down in the first fluid transfer portions 4. The second manifold 8 receives the evaporated internal cooling fluid from the first conduit elements 1 in turn supplied with liquid internal cooling fluid by the first manifold 7. In the second conduit elements 11 the evaporated internal cooling fluid from the second manifold 8 further cools down to finally condense. The condensed internal cooling fluid is fed back to the first manifold 7. In this exemplary embodiment the internal cooling fluid circuit can thus be formed by the first manifold 7, the plurality of first conduit elements 1, the second manifold 8, and the plurality of second conduit elements 11 established by one piece formed heat releasing portion 11.1 and second fluid transfer portion 11.2.

On a side of the common plane II' directed away from the second conduit elements 11, heat sources 15 can be arranged in a first reception volume 16. On the side of the common plane II' directed towards the second conduit elements 11 a heat capacitance plate 14 can be arranged in a second reception volume 17. The heat capacitance plate 14 serves as heat buffer and heat shield. The material of the heat capacitance plate 14, the manifolds 7, 8 and the multi-port extruded tubes 4 and 11 can typically be aluminium or any aluminium alloy or other suitable material which combines good heat conduction properties with small weight. Thus, a cooling of internal cooling fluid in the further conduit elements is not hindered.

The thermosyphon heat exchanger 6' can have an alternative heat absorbing region 100', an alternative fluid transfer region 101' and an alternative heat releasing region 102'.

The alternative heat absorbing region 100', the alternative fluid transfer region 101' and the alternative fluid transfer region 102' serve as evaporator, transfer region and condenser region for the internal cooling fluid respectively.

Between every two directly neighbouring second conduit elements 11 can be arranged one cooling element 10.

Figure 5:
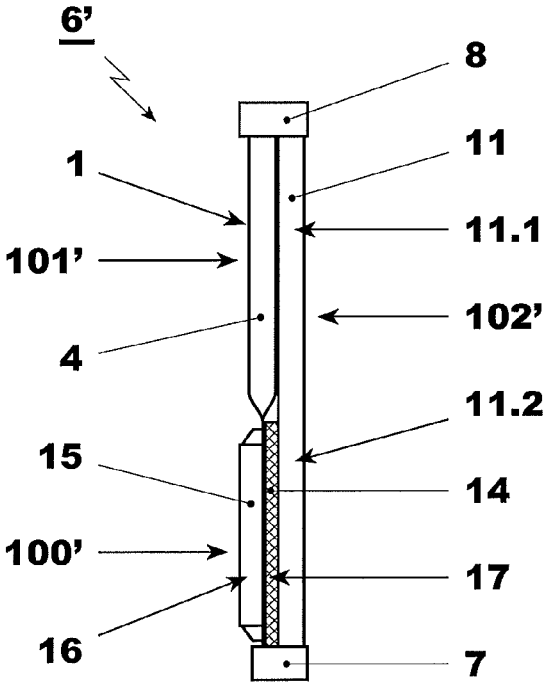
FIG. 5 shows a second perspective of a second exemplary embodiment of the thermosyphon heat exchanger.

FIG. 5 shows a side view of a second exemplary embodiment of the thermosyphon heat exchanger 6' according to the disclosure shown in FIG. 4. Like numerals are used to indicate like parts. Instead of the heat capacitance plate 14 a further heat source (not shown) may be placed in the second reception volume 17.

The exemplary embodiments described are used as examples. The disclosure, however, is not limited to these exemplary embodiments. The features may be combined in an advantageous and functional manner. In particular, a plurality of manifolds can be used as collectors and/or suppliers of internal cooling fluid being inter connected by feeder lines and/or further conduit elements.

A exemplary embodiment of a thermosyphon heat exchanger includes at least one conduit element having a heat absorbing portion defining a first plane and a first longitudinal axis included therein and a heat releasing portion defining a second plane and a second longitudinal axis included therein. The first longitudinal axis and the second longitudinal axis are parallel, with respect to which the first plane and the second plane are twisted relative to each other. A further exemplary embodiment including at least two conduit elements can have at least two first planes that are arranged plane-parallel to one another. A further exemplary embodiment having a plurality of conduit elements has at least two plane-parallel first planes and/or at least one group of first planes being arranged plane-parallel to one another. Further exemplary embodiments can be combinable with the thermosyphon heat exchanger described above.

The cooling elements 10, 12 can be formed in different ways and be of different materials. They are used to absorb heat and to enlarge the cooling surface of the thermosyphon heat exchanger. Their particular structure such as cooling fins, for example, is well known for heat exchangers. Thus, a detailed description thereof is omitted.

A cooling of a thermosyphon heat exchanger may be performed by a external cooling fluid flow flowing through the thermosyphon heat exchanger from the first fluid transfer region 101(') to the heat releasing region 102' or vice verse. The external cooling fluid is preferably a gas or gas mixture.

Both the number and the density of both first conduit elements 1 and of second conduit elements 11 may vary and be set individually.

The heat sources can be electronic devices. Preferably, the heat sources fit in the first reception volume 16. The thermosyphon heat exchanger according to an exemplary embodiment is an automotive heat exchanger.

The energy for running the circulation of internal cooling fluid described above can be provided by the heat source or sources to be cooled.

The angle $\alpha$ may vary between an angle near 0° and +/−180° included.

While the elements of the exemplary embodiments are shown in different configurations, which are exemplary, other combinations and configurations of the elements are also within the spirit and scope of the disclosure as defined in the following claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. Thermosyphon heat exchanger, comprising:

a plurality of first conduit elements wherein at least one first conduit element includes:

a heat absorbing portion extending in a first plane, and a first fluid transfer portion extending in a second plane, wherein the first plane and the second plane being twisted relative to each other about an angle of a twisting axis; and a plurality of second conduit elements, at least one second conduit element having a heat releasing portion being fluidly connected to the first fluid transfer portion of the at least one first conduit element and to the heat absorbing portion via a second fluid transfer portion of the at least one second conduit element and/or a connection to a fluid return line, for fluid to flow in a closed loop through said at least one first conduit element and said at least one second conduit element wherein each second conduit element is arranged to extend in a single plane.

2. Thermosyphon heat exchanger according to claim 1, wherein the heat absorbing portion defines a first longitudinal axis included in the first plane and the first fluid transfer portion defines a second longitudinal axis included in the second plane, wherein the first longitudinal axis and the second longitudinal axis extend parallel to each other.

3. Thermosyphon heat exchanger according to claim 1, wherein at least two first planes of the plurality of conduit elements are plane-parallel to one another, and in that a twisted portion of at least one first conduit element of the plurality of first conduit elements extends over a length of about 5 to about 30 percent of a total length of the at least one first conduit element.

4. Thermosyphon heat exchanger according to claim 1, wherein at least one first conduit element of the plurality of first conduit elements and/or at least one second conduit element of the plurality of second conduit elements comprises at least two channels and in that the first plane comprises a mounting area designed to receive at least one electric and/or electronic power component.

5. Thermosyphon heat exchanger according to claim 1, wherein at least two second planes extending parallel to each other to form a mounting area.

6. Thermosyphon heat exchanger according to claim 1, wherein at least one first conduit element of the plurality of first conduit elements is a twisted multi-port extrusion tube.

7. Thermosyphon heat exchanger according to claim 1, wherein at least one first conduit element is fluidly connected to a first manifold and/or a second manifold and in that the first fluid transfer portion overlaps at least partially with the heat releasing portion.

8. Thermosyphon heat exchanger according to claim 7, wherein the first manifold is arranged between the plurality of second conduit elements and below a plurality of heat absorbing portions.

9. Thermosyphon heat exchanger according to claim 7, wherein the first manifold and the second manifold are fluidly connected to one another by at least one second conduit element extending in a third plane and a third longitudinal axis included therein, and wherein the third longitudinal axis extends parallel to at least one of the longitudinal axis and the second longitudinal axis.

10. Thermosyphon heat exchanger according to claim 9, wherein at least one further cooling element is arranged between two second conduit elements, in particular between two neighbouring second conduit elements.

11. Thermosyphon heat exchanger according to claim 9, wherein at least two third planes extend parallel to each other and/or at least one third plane extends perpendicularly, to at least one first plane.

12. Thermosyphon heat exchanger according to claim 9, wherein at least one third plane is arranged plane-parallel to at least one second plane.

13. Thermosyphon heat exchanger according to claim 7, wherein a third manifold is fluidly connected to the heat releasing portion of at least one second conduit element with the first manifold.

14. Thermosyphon heat exchanger according to claim 13, wherein the fluid connection of the first manifold and the third manifold is established by a common return line or at least one second fluid transfer line.

15. Thermosyphon heat exchanger according to claim 7, wherein the second manifold is arranged between a plurality of first fluid transfer portions and above the plurality of second conduit elements.

16. Thermosyphon heat exchanger according to claim 7, wherein the first manifold is arranged between the plurality of second conduit elements and below a plurality of heat absorbing portions, and wherein the second manifold is arranged between a plurality of first fluid transfer portions and above the plurality of second conduit elements.

17. An electric and/or electronic device, comprising:

at least one heat emitting electric and/or electronic power component that is thermally connected to at least one thermosyphon heat exchanger according to claim 1.

18. Thermosyphon heat exchanger according to claim 1, wherein at least two first planes of the plurality of conduit elements are plane-parallel to one another, and in that a twisted portion of at least one first conduit element of the plurality of first conduit elements extends over about 8 to about 20 percent of a total length of the at least one first conduit element.

19. Thermosyphon heat exchanger according to claim 1, wherein at least one second plane is aligned perpendicularly, to the at least one first plane to form a mounting area.

20. Thermosypon heat exchanger according to claim 1, wherein the plurality of first conduit elements include first fluid conducting channels having channel walls and the plurality of second conduit elements include second fluid conducting channels having channel walls, the first fluid conducting channels and the second fluid conducting channels have no common channel wall.

21. Thermosypon heat exchanger according to claim 20, wherein the plurality of first conduit elements are stacked with the plurality of second conduit elements.

* * * * *